US012570377B1

(12) United States Patent
Nelson

(10) Patent No.: US 12,570,377 B1
(45) Date of Patent: Mar. 10, 2026

(54) AFLOAT STRUCTURE FOR LAUNCHING AND RECOVERING VESSELS

(71) Applicant: The United States of America as represented by the Secretary of the Navy, Newport, RI (US)

(72) Inventor: Bryon A Nelson, Charlestown, RI (US)

(73) Assignee: The United States of America as represented by the Secretary of the Navy

( * ) Notice: Subject to any disclaimer, the term of this patent is extended or adjusted under 35 U.S.C. 154(b) by 751 days.

(21) Appl. No.: 17/954,369

(22) Filed: Sep. 28, 2022

(51) Int. Cl.
*B63B 27/14* (2006.01)

(52) U.S. Cl.
CPC ..... *B63B 27/143* (2013.01); *B63B 2027/145* (2013.01)

(58) Field of Classification Search
CPC ..... B63B 27/143; B63B 2027/145
See application file for complete search history.

(56) References Cited

U.S. PATENT DOCUMENTS 6,536,715 B1 * 3/2003 Moran ..... B64D 25/14 193/25 B
6,799,741 B2 * 10/2004 Danielson ..... B64D 25/14 244/905
6,983,823 B1 * 1/2006 Zumbrunnen ..... E06C 5/00 114/362
11,828,322 B2 * 11/2023 Nelson ..... B63C 3/02
2012/0100765 A1 * 4/2012 Simon Bouhet ..... B63C 9/22 441/39
2022/0119077 A1 * 4/2022 Nelson ..... B63C 3/02
2024/0124101 A1 * 4/2024 MacRae ..... B63B 27/143
2025/0043632 A1 * 2/2025 Zinai ..... E06C 1/06

FOREIGN PATENT DOCUMENTS

CN 110040219 A * 7/2019 ..... B63B 27/143
FR 75 04897 * 8/1976

* cited by examiner

*Primary Examiner* — Gary S Hartmann
(74) *Attorney, Agent, or Firm* — James M. Kasischke; Jeffry C. Severson

(57) ABSTRACT

An afloat structure configured to launch and recover a vehicle includes a ramp having a first end and a second end distal from the first end, a transverse member coupled between a left side and a right side of the ramp at the second end, a plurality of spaced apart longitudinal members extending from the transverse member between the left side and the right side of the ramp, and a plurality of spaced apart arcuate members, each arcuate member coupled to each of the plurality of spaced apart longitudinal members. The longitudinal members and the arcuate members form a guide structure configured to guide the vehicle away or toward the second end of the ramp. A kit may include all of the components of the structure packaged into one or more containers.

16 Claims, 7 Drawing Sheets

AFLOAT STRUCTURE FOR LAUNCHING AND RECOVERING VESSELS

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER APPLICATIONS

None.

BACKGROUND OF THE INVENTION

(1) Field of the Invention

The present disclosure relates to ramps for vehicle launch and recovery from vessels at sea. Specifically, the present disclosure relates to structures on surface vessels or as part of a stationary area with the structure configured to launch and recover objects, vehicles or vessels.

(2) Description of the Related Art

The launch and recovery of vehicles from a vessel or a stationary area often requires structures, such as a ramp, an A-frame, a crane, an integrated launch and recovery system, or to have features that support a temporary attachment of one or more of the structures. However, not all vessels or stationary areas have these features that support temporary attachments for launch and recovery. Those structures or features may not be scalable and may not be capable of handling the majority of static and dynamic loads experienced during the launch and recovery operations of vehicles.

BRIEF SUMMARY OF THE INVENTION

The present disclosure relates to afloat structures or a structure that can be on a stationary area (such as a pier) for vehicle launch and recovery. The inventive structure includes: a ramp having a first end and a distal second end; a transverse member coupled between a first side and a second side of the ramp at the second end and optionally the first end; spaced apart longitudinal members extending from the transverse member between the first side and the second side of the ramp; and spaced apart arcuate members.

Each arcuate member is coupled to each of the longitudinal members. The longitudinal members and the arcuate members form a structure to guide the vehicle at launch or recovery away or toward the second end of the ramp.

In another example, a kit is provided. The kit includes: a ramp having a first end and a second end distal from the first end; a transverse member coupled between a first side and a second side of the ramp at the second end and another transverse member optionally at the first end; a plurality of longitudinal members extending from the transverse member between the first side and a second side of the ramp and a plurality of arcuate members. Each arcuate member couples to each of the longitudinal members. The kit also includes a container to store the ramp, the transverse members, the longitudinal members and the arcuate members.

These and other aspects will become more fully understood upon a review of the detailed description, which follows. Other aspects and features will become apparent to those of ordinary skill in the art, upon reviewing the following description of specific, exemplary embodiments in conjunction with the accompanying figures.

BRIEF DESCRIPTION OF THE DRAWINGS

Reference is made to the accompanying drawings in which are shown an illustrative embodiment of the invention, wherein corresponding reference characters indicate corresponding parts, and wherein.

DETAILED DESCRIPTION OF THE INVENTION

Figure 1:
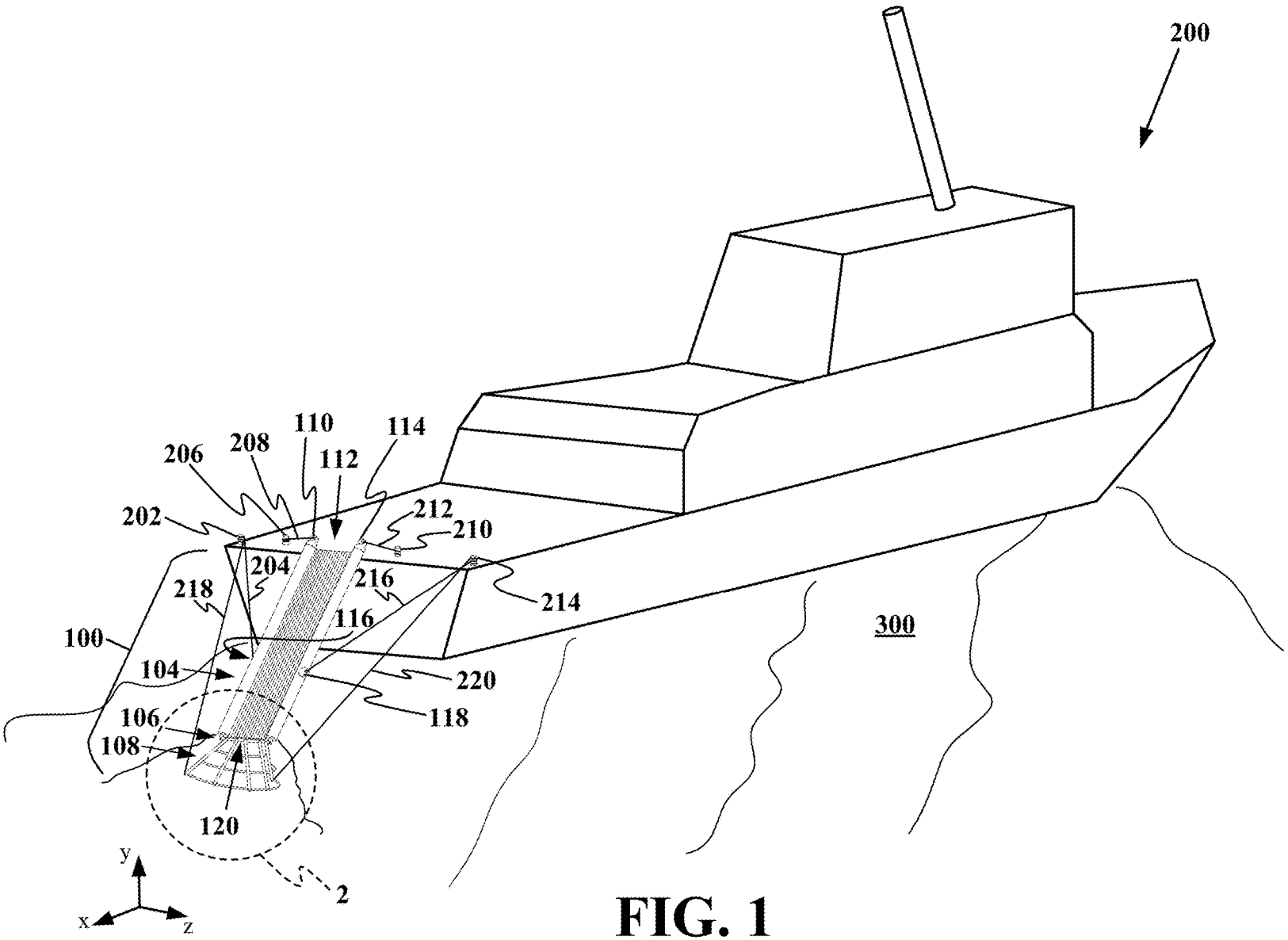
FIG. 1 depicts a structure in accordance with the present invention.

The detailed description set forth in connection with the appended drawings is a description of various configurations and is not intended to represent the only configurations in which the concepts described herein may be practiced. The description includes specific details for the purpose of providing a thorough understanding of various concepts. However, it will be apparent to those skilled in the art that these concepts may be practiced without these specific details. In some instances, details of well-known structures and components are shown in simplified form in order to avoid obscuring such concepts.

An inventive structure is provided to launch and recover from a vessel afloat; however, the structure can be installed as part of a stationary area such as a pier. The structure is coupled at a first end to a deck of a vessel, at the stern, or at a side of the vessel. The structure includes an inclined plane (referred to herein as a ramp) which supports and defines a path for lowering and raising objects between the first end (coupled to the deck of the vessel) and a second end, terminating at a surface by floating on the surface, terminating below the surface, or a combination thereof of a body of water. In use, objects, vehicles and vessels can slide toward the first end or slide toward the second end along a surface of the ramp.

An exemplary structure includes a submerged or semi-submerged guide at the second end of the ramp with the guide being a tapered structure where the taper is narrowest adjacent to the second end and widens with distance from the second end. The guide includes longitudinal members, arcuate (e.g., curved) members, or a combination thereof that can act similar to a spatula to scoop up the object, vehicle or vessel.

Alternatively, the guide may resemble one-half of a truncated cone in which the guide is flattened at an edge which is adjacent to the second end of the ramp. Also, the guide may resemble one-half of a clamshell with a flattened rather than a concave shape. A flat hinge of the clamshell can attach to the second end of the ramp.

The ends of the longitudinal members may be rotatably coupled to the transverse member, fixedly coupled to the transverse member or a combination of being fixedly coupled and rotatably coupled to the transverse member. The fixed coupling, rotatable coupling, or combination of fixed and rotatable couplings of the ends of the longitudinal members to or with the transverse member collectively facilitate rotation of the guide around an axis of the transverse member. The ends of the longitudinal members that are distal from the transverse member may be collinear with a semi-circular, semi-parabolic, or semi-elliptical line.

The arcuate members form individual arcuate segments of different curvatures with each arcuate segment spaced apart from an adjacent arcuate segment. A curve of the arcuate members corresponds to the guide curvature or the arcuate members may have different radii. A first radius of a first arcuate member that is most closely adjacent to the transverse member may be less than a second radius of a second arcuate member that is most distant from the transverse member. The arcuate members may be straightened rather than having curvatures.

As an aide to buoyancy, some or all of the longitudinal members and the arcuate members may be hollow or solid. Non-watertight longitudinal members and the arcuate members can facilitate water drainage from within the hollow portions of the longitudinal members and the arcuate members.

FIG. 1 depicts a structure 100 to launch and recover vehicles afloat from a water surface 300 according to the present invention. As shown in the figure, a ship, referred to herein as a vessel 200, has the structure 100 configured from the stern. Alternatively, the structure 100 can be configured from a port side or a starboard side of the tending vessel 200. The structure 100 includes a ramp 104, a transverse member 106, and a guide 108.

The ramp 104 has a first boss 110 protruding from a left or first corner of the ramp at a first end 112. A second boss 114 protrudes from a right corner or a second corner of the ramp 104 at the first end 112. The first boss 110 and the second boss 114 couple the ramp 104 to the tending vessel 200.

In an optional configuration, the ramp 104 has a first intermediate boss 116 protruding from a left or first side of the ramp at a first intermediate point along the length of the ramp. The ramp 104 has a second intermediate boss 118 protruding from a right or second side of the ramp at an intermediate point along the length of the right side of the ramp. In FIG. 1, the first intermediate boss 116 and the second intermediate boss 118 are each located midway between the first end 112 and a second end 120 of the ramp 104. The first intermediate boss 116 and the second intermediate boss 118 can be located at other positions than midway between the first end 112 and a second end 120 of the ramp 104. Additional intermediate bosses may be located between the first end 112 and the second end 120.

The total number of intermediate bosses depend on the length of the ramp 104, the strength of the attachment between each boss and a respective side of the ramp, the weight of the ramp, the weight of objects which may traverse the ramp, or any combination of these factors.

The first boss 110, the second boss 114, the first intermediate boss 116 and the second intermediate boss 118 may be a flap of material having a grommet therein. The grommet would also serve as an attachment point for a clevis, carabiner, or other type of connector or attachment feature.

The first boss 110, the second boss 114, the first intermediate boss 116, and the second intermediate boss 118 may be a rigid or flexible shaft, with or without any bend therein or curvature thereto, where the ends of the shaft are coupled to the ramp 104 or made integral thereto. The rigid or flexible shaft can lie adjacent to a recess on the side of the ramp 104. The recess provides a space through which the line or rope, a chain, a cable, a carabiner, a hook, a clevis, or some other component can pass through.

The ramp 104 may be coupled to the stern of the tending vessel 200. In the figure, a plurality of bitts extend from a surface of the deck of the tending vessel 200 where lines, ropes, cables, chains, or any combination thereof couple to and between the bitts and bosses. A first bitt 202 couples to the first intermediate boss 116 via a first line 204. A second bitt 206 couples to the first boss 110 via a second line 208. A third bitt 210 couples to the second boss 114 via a third line 212 and a fourth bitt 214 couples to the second intermediate boss 118 via a fourth line 216.

The first bitt 202 couples to a left-side distal end of the guide 108 via a fifth line 218, and the fourth bitt 214 couples to a right-side distal end of the guide 108 via a sixth line 220. Additional lines can secure to a bitt or another structure can secure the lines. Additional bitts can secure to additional lines.

Figure 2:
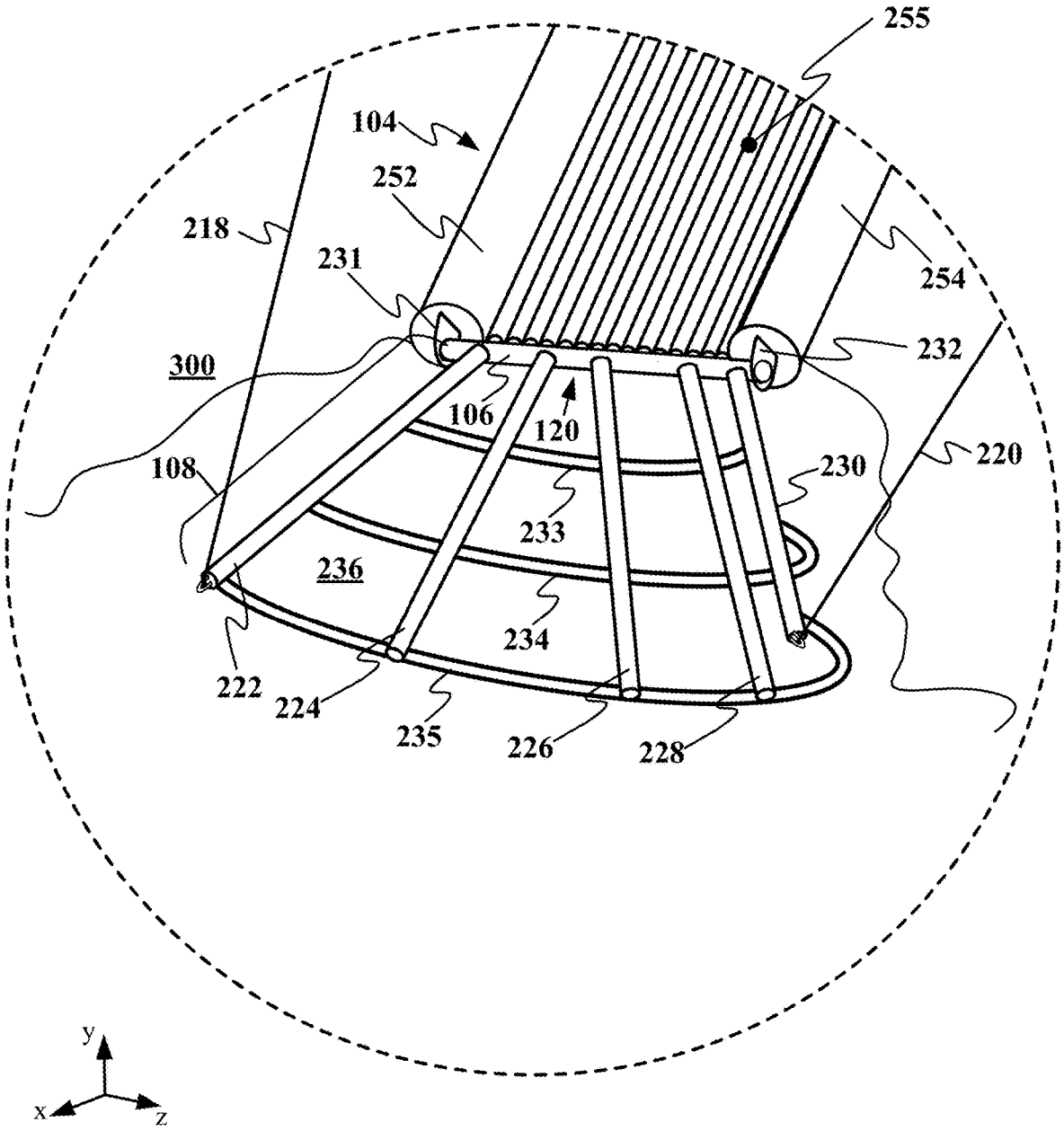
FIG. 2 is an expanded view of a guide and adjacent portions of the structure of FIG. 1 in accordance with the present invention.

FIG. 2 is an expanded view of the guide 108 and portions of the structure 100 that are adjacent to the guide on the water surface 300. The guide 108 couples to the second end 120 of the ramp 104 via the transverse member 106. The transverse member 106 may be fixedly coupled to the guide 108 with an axle (not shown) that passes axially through the center of the transverse member in order to permit the guide to rotate about the axle.

The guide 108 comprises of a plurality of spaced apart longitudinal members (a first longitudinal member 222, a second longitudinal member 224, a third longitudinal member 226, a fourth longitudinal member 228 and a fifth longitudinal member 230). Ends of the longitudinal members 222-230 spaced apart from the second end 120 of the ramp 104 can be straightened. The longitudinal members 222-230 can extend outwardly from the transverse member 106, either perpendicular to the transverse member or fanned out relative to the transverse member.

Each of the longitudinal members 222-230 is depicted as straightened; however, the longitudinal members can have various shapes and different lengths. Two or more of the longitudinal members 222-230 may be rotatably coupled to the transverse member 106 in order to facilitate axial rotation of the guide 108 around the transverse member.

The transverse member 106 couples to the ramp 104 via a first coupling 231 on a first (or left side) of the ramp and a second coupling 232 on a second (or right side) of the ramp. The first coupling 231 and the second coupling 232 facilitate a fixed or rotatable coupling of the transverse member 106 (or an axle passing axially through the transverse member) to the second end 120 of the ramp 104.

For example, ends of the transverse member 106 can pass through apertures defined by inner walls (e.g., through holes) in each of the first coupling 231 and the second coupling 232. End parts, caps, or hat-type features may be placed on or secured to the ends of the transverse member 106 in order to prevent the transverse member from being withdrawn from the openings. Splines, rings, washers or the like may be located on the transverse member 106 to limit the distance to which the transverse member penetrates the first coupling 231 and the second coupling 232 via the openings therein.

The first coupling 231 and the second coupling 232, with the transverse member 106 fixedly or rotatably coupled therein, maintain a predetermined distance between the first and second sides of the ramp 104 at the second end 120. For example, if the ramp 104 is designed to have a nominal ten-foot width at the second end 120 and if a weight is placed at a point midway between the left and right sides of the ramp at the second end; then that weight may otherwise cause the point to sink and thereby cause the right and left sides of the ramp to come toward each other at the second end.

The guide 108 includes spaced apart longitudinal members, such as the first longitudinal member 222, the second longitudinal member 224, the third longitudinal member 226, the fourth longitudinal member 228 and the fifth longitudinal member 230. Guides that may have a fewer or a greater number of longitudinal members are within the scope of the disclosure. The outermost longitudinal members are the first longitudinal member 222 and the fifth longitudinal member 230 in which each of these longitudinal members may be fitted with pad eyes.

In the example of FIG. 2, the first coupling 231 and the second coupling 232 are depicted as flange-like bodies that protrude from the ends of the ramp 104. Any structure that enables a fixed or rotatable coupling between the transverse member 106 and the ramp 104 is within the scope of the invention.

Each arcuate member 233, 234, 235 couples to each of the longitudinal members 222-230. Collectively, the longitudinal members 222-230 and the arcuate members 233, 234, 235 (with or without the transverse member 106) form the guide 108.

An opening formed within the intersections of two of the longitudinal members 222-230 and two of the arcuate members 233-235 define an interstice 236 of the guide 108. A plurality of interstices (such as the interstice 236) facilitate the passage of water through the guide 108 and the passage of the guide through the water. The smaller the interstices, the greater the drag on the guide 108.

Smaller interstices augment the greater structural integrity of the guide 108. The larger the interstices; the lesser the drag on the guide 108. Larger interstices may correspond to a lesser structural integrity of the guide 108. Accordingly, a balance between drag and structural integrity is obtained by increasing or decreasing the size of the interstices 236. For example: larger interstices can be made stronger and thicker to accommodate a load.

The ramp 104 can be foldable and includes a first or left chamber 252, a second or right chamber 254 and a floor chamber 255. The left chamber 252, the right chamber 254, and the floor chamber 255 can be inflatable. The inflatable portions of the structure 100 allow for compact stowage, reduced weight, and an overall reduced footprint on the tending vessel 200. The floor chamber 255 includes a plurality of parallel sub-chambers. In other configurations, the sub-chambers of the floor chamber 255 run perpendicular to the left chamber 252 and the right chamber 254. The floor chamber 255 can also be a single chamber.

The left chamber 252 and the right chamber 254 are separate airtight chambers. In other examples, the left chamber 252 and the right chamber 254 can be divided into airtight sub-chambers. In another configuration, the entire ramp 104 is an inflatable chamber.

Figure 3:
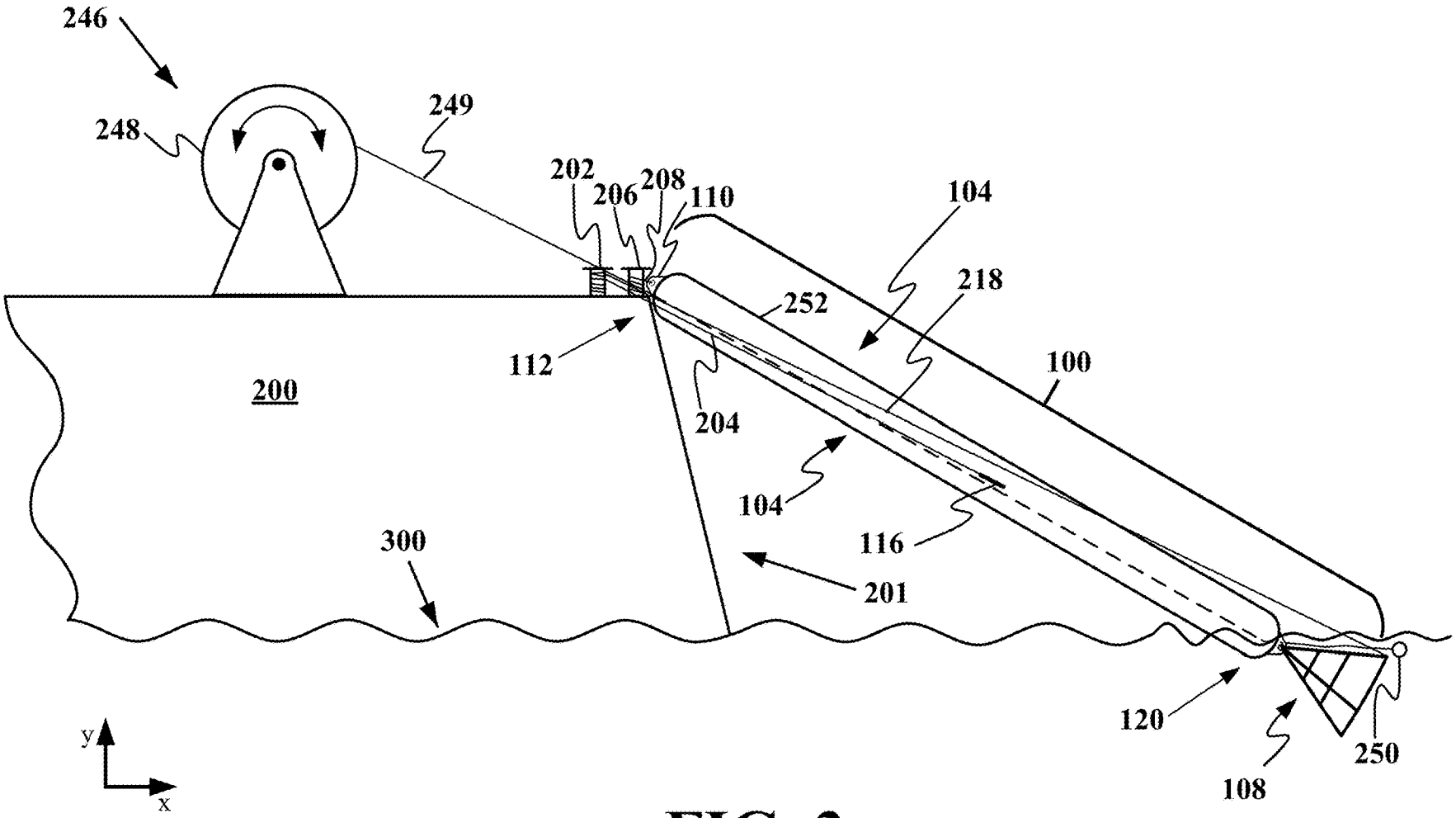
FIG. 3 is an elevation view of the structure in accordance with the present invention, where the structure is coupled to a stern of an afloat vessel.

Each of the sub-chambers may be filled with a compressed gas such as air, nitrogen, or carbon dioxide. In some examples, the gas may be in a liquid state or the gas may be generated by a chemical reaction. Also, the floor chamber 255 may include a plurality of contiguous floor chambers with the contiguous floor chambers inflated in groups. Each of the groups may be airtight and independent of any other group. FIG. 3 is an elevation view of the structure 100 to launch and recover vehicles, where the structure is coupled to a stern 201 of the tending vessel 200. The structure 100 include the ramp 104 and the guide 108 coupled to the ramp. A winch 246 is coupled to a deck of the tending vessel 200. A drum 248 of the winch 246 can rotate to reel in or pay out a line 249. The water surface 300 is depicted with spaced-apart swells.

In FIG. 3, the first bitt 202 is coupled to the first intermediate boss 116 via the first line 204 and to the guide 108 via the fifth line 218. The second bitt 206 is coupled to the first boss 110 via the second line 208. The first end 112 of the structure 100 couples to the deck at the stern 201 of the tending vessel 200. The floor chamber at the first end of the ramp 104 is approximately even with the deck of the tending vessel 200. However, multiple adjacencies between the floor chamber of the ramp 104 and the deck are within the scope of the invention. For example, the floor of the ramp 104 (adjacent to the first end 112) may be at any height between a first height of the deck above the water surface 300.

In the figure, the second end 120 of the structure 100 is depicted as partially submerged below the water surface 300. The submergence depth of the second end 120 depends on the weight of the ramp 104, the weight of the guide 108, the weight of the transverse member 106, and the weight of any object including personnel, watercraft, or both that are supported by the ramp or toward the second end 120 of the ramp 104.

The line 249 from the winch 246 travels from the drum 248 to the first end 112 of the ramp 104. The line 249 (shown in dashed-line form as the line passes between the left chamber 252 and the right chamber 254) is hidden from view by the left chamber as the line extends toward the second end 120 of the ramp 104. The line 249 exits the ramp 104 at the second end 120 of the ramp and trails the structure 100 between the water surface 300 and the guide 108.

The end of the line 249 includes a line retrieval feature 250 (a loop, a knot, a carabiner, a connector, a handle, a float). The line retrieval feature 250 is provided for a person on a surface or subsurface vehicle, or for an autonomous, semi-autonomous, or automatic feature of a surface or subsurface watercraft, to obtain (e.g., grasp, hook, or otherwise capture) the line 249. Once obtained, the line 249 may be coupled to the surface or subsurface vehicle, and the winch 246 reels in the line to draw the surface or subsurface vehicle over the guide 108 (between the outermost longitudinal members of the guide) and toward the second end 120 of the ramp 104. The line 249 can be used from the vessel to land while sliding. Other than the winch 246, an option for launch recovery can be by manual pulling and release.

Figure 4:
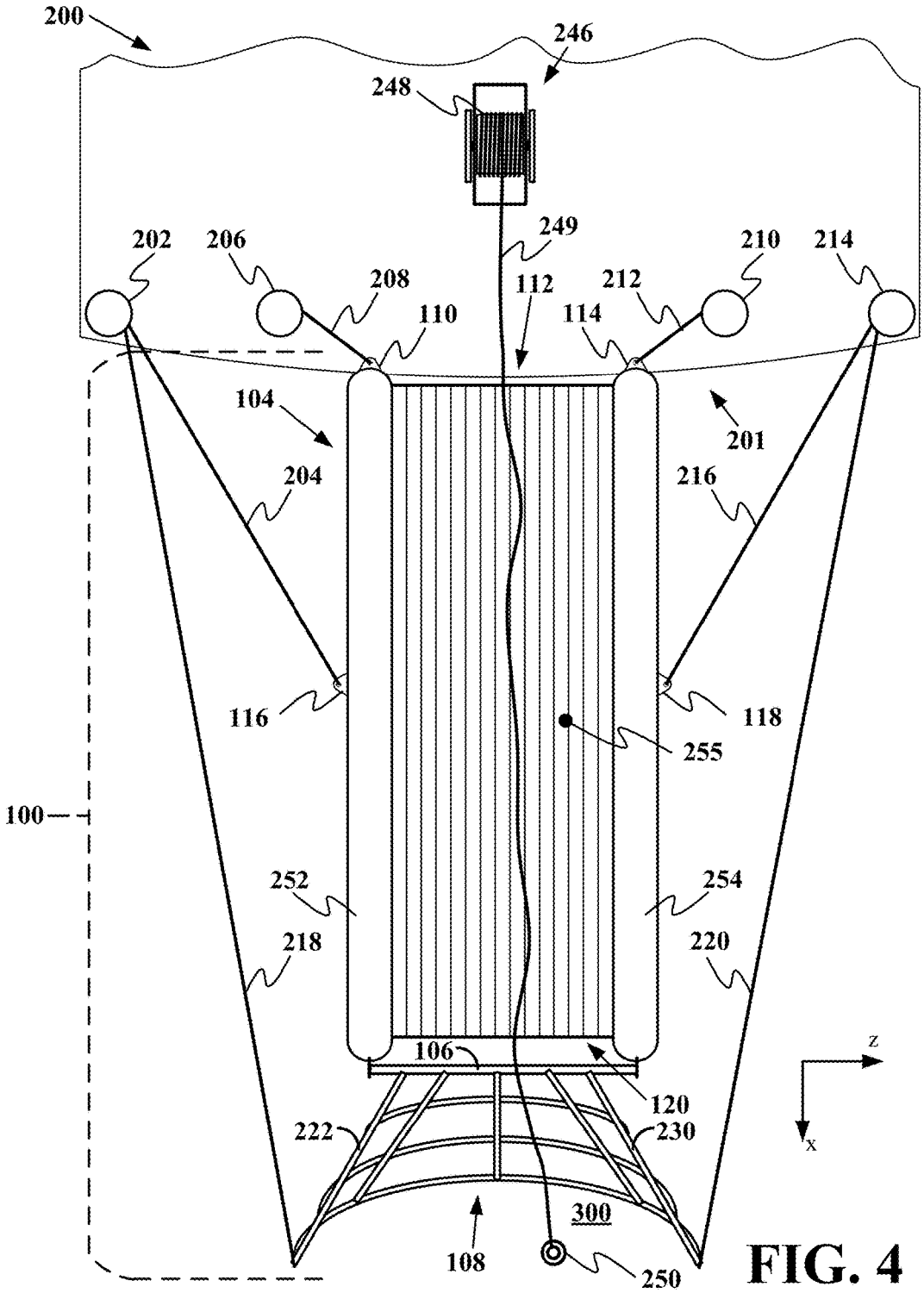
FIG. 4 is a plan view of FIG. 3.

FIG. 4 is a plan view of the structure 100. As shown and described in connection with FIG. 3, the structure 100 includes the ramp 104 and the guide 108 coupled to the ramp via a transverse member 106. The ramp 104 includes the first or left chamber 252 on the left side of the ramp, the second or right chamber 254 on the right side of the ramp, and the floor chamber 255 bridging between the first and second chambers. The figure also provides a plan view of the winch 246 coupled to the deck. The line 249 is rotatably secured around the drum 248 and trailing at a far end, behind and above the guide 108.

The third bitt 210, the second boss 114, the third line 212, the fourth bitt 214, the second intermediate boss 118, and a fourth line 216 are described in connection with FIG. 4. The third bitt 210 couples to the second boss 114 via the third line 212 and the fourth bitt 214 couples to a second intermediate boss 118 via the fourth line 216. The fourth bitt 214 also couples to the guide 108 via the sixth line 220. Other ways of coupling the structure 100 to the stern 201 (or to a side) of the tending vessel 200 are within the scope of the disclosure.

The first end 112 of the structure 100 couples to the deck at the stern 201 of the tending vessel 200. In the example, the floor chamber 255 is spaced apart from an edge of the deck. The floor chamber 255 (at the first end 112 of the structure 100) may not be spaced apart from the rear edge of the deck, may overlap the deck, or if there is a space below the deck; the deck may overlap the floor chamber at the first end.

The line 249 from the winch 246 travels from the drum 248 across the floor chamber 255 and trails the structure 100 between the water surface 300 and the guide 108. The retrieval feature 250 can be affixed to the end of the line 249. Once obtained, the line 249 is coupled by the retrieval feature 250 to a surface or subsurface vehicle, and the winch 246 reels in the line to haul the objects, vehicles and vessels over the guide 108, between the outermost longitudinal members 222, 230 and toward the second end 120 of the ramp 104.

Figure 5:
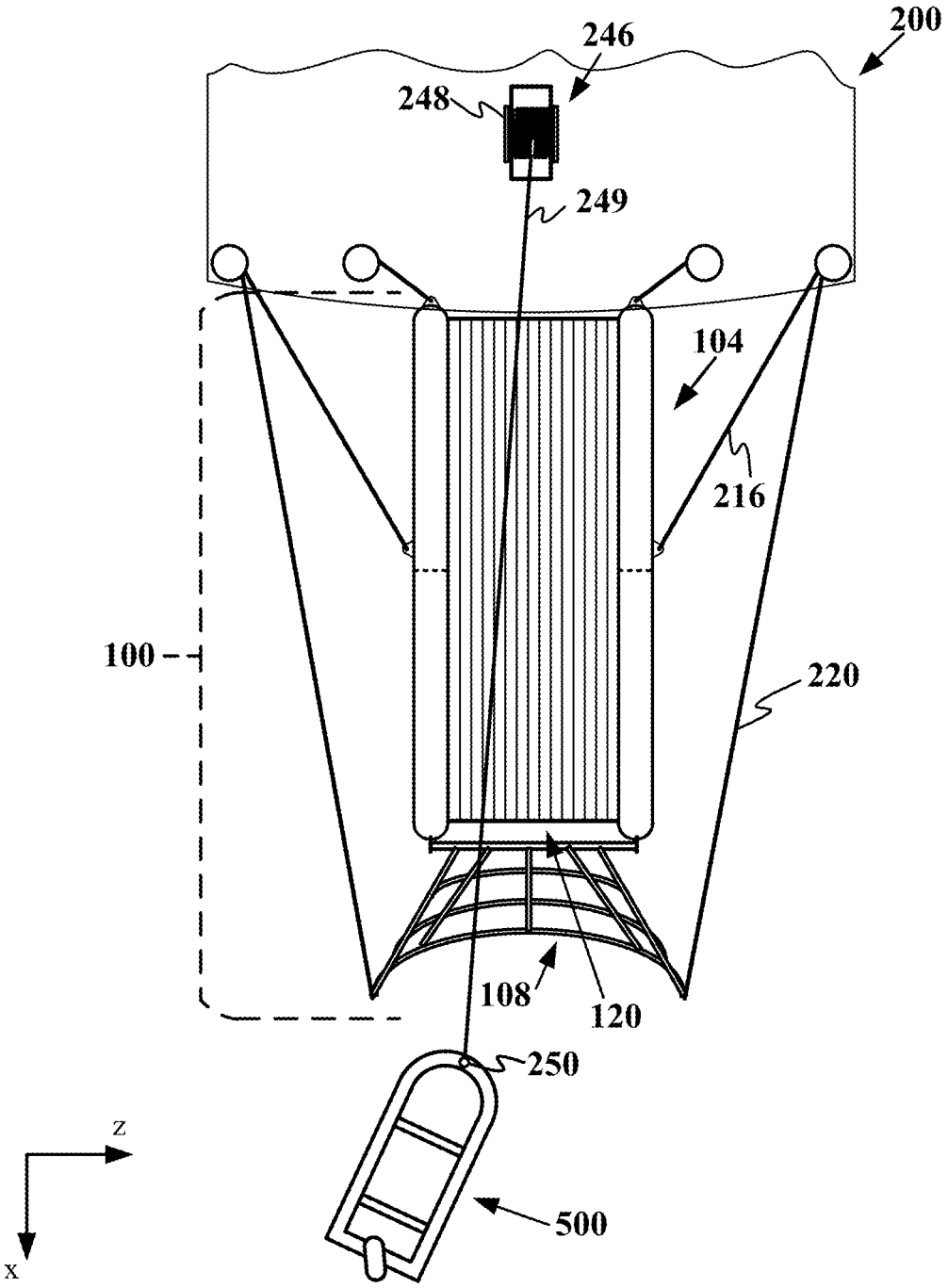
FIG. 5 is the plan view of f FIG. 4 and a vehicle.

FIG. 5 is the plan view of the structure 100 for launching and recovering a vehicle 500. The vehicle 500 may be a rigid hull inflatable boat (RHIB) or an inflatable raft. The vehicle 500 is towed behind, hauled toward, or recedes from, the second end 120 of the ramp 104. The vehicle 500 can use an outboard motor, an inboard motor, oars, or any combination thereof to steer the vehicle relative to the ramp 104 and to move toward or away from the ramp. The line retrieval feature 250 or the obtained line 249 may be coupled to the vehicle 500. Propulsion and steering mechanisms of the vehicle 500 may be used to assist retrieval.

The winch 246 by rotation of the drum 248, can haul the vehicle 500 toward or reel the vehicle from the ramp 104. The guide 108 can funnel the vehicle 500 toward a center of the second end 120 of the ramp 104. The guide 108 may contact the bottom, or the sides of the vehicle 500, below or at the water line of the vehicle. By an action of the vehicle 500 sliding over the guide 108; the vehicle aligns with the ramp 104.

Figure 6:
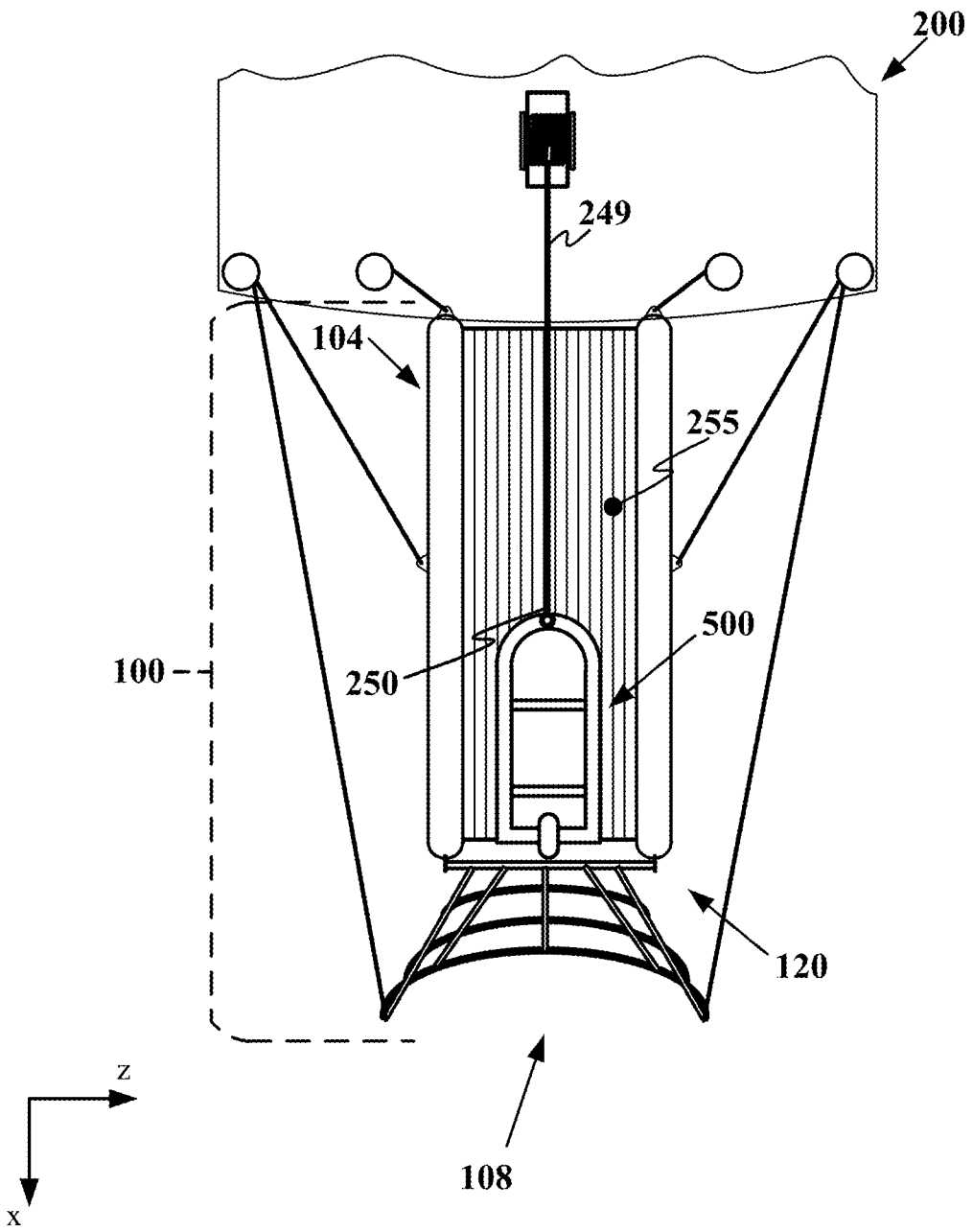
FIG. 6 is another plan view of the structure of FIG. 4 and the vehicle of FIG. 5.

FIG. 6 depicts the vehicle 500 partially hauled onto the second end 120 of the ramp 104. The vehicle 500 is held in place by tension on the line 249, by friction between the bottom of the vehicle and a top surface of the floor chamber 255, by the action of the motor continually pushing the vehicle against (and onto) the ramp 104.

Figure 7:
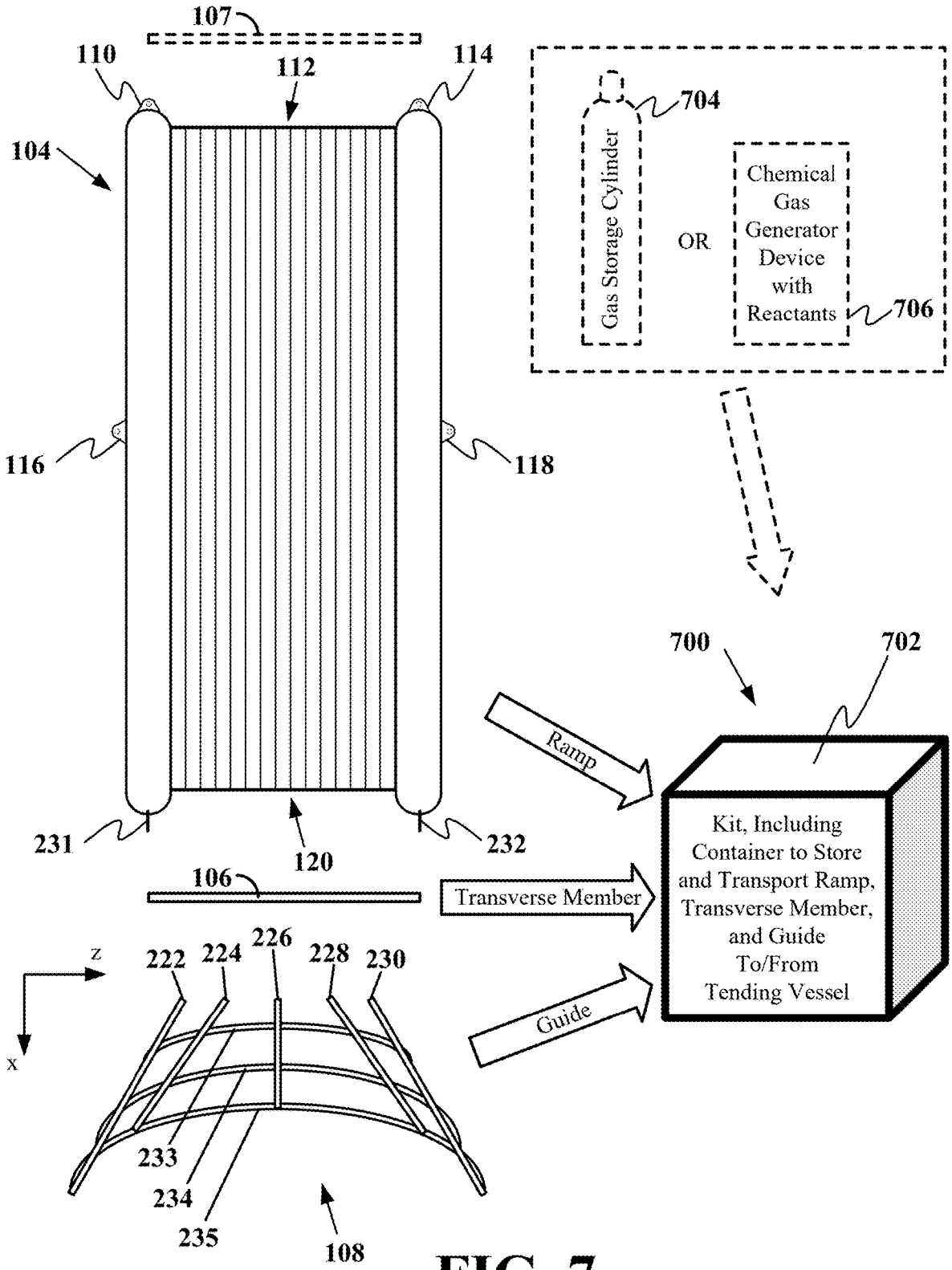
FIG. 7 is a schematic of a retrieval kit in accordance with the present invention.

FIG. 7 is a schematic view of a kit 700 including a container 702, the ramp 104, the transverse member 106, the guide 108, an optional gas storage cylinder 704 or an optional chemical gas generator device with reactants 706. The container 702 may be a box, a crate, or a case and the container may be a one-time use container or may be reusable (e.g., may be opened and closed and utilized to store and transport the components of the kit 700 one or more times).

The kit 700 can be transported to a tending vessel over land, air, sea, or any combination thereof. The container 702 may be unpackaged. Once removed from packaging, the folded ramp 104, a transverse member 106, the guide 108 and an optional transverse member 107 can form a structure configured to launch and recover vehicles. The container 702 can be multiple containers.

The ramp 104 may be flexible to be inflated and deflated. In a deflated state, the ramp 104 can be folded to fit within the container 702. The transverse member 106 coupled to or uncoupled from the first coupling 231 and the second coupling 232 of the ramp 104, fits within the container 702 with the folded ramp. A transverse member 106 can be added as an option for the first end 112.

The guide 108 may be one rigid body (e.g., welded or brazed together) with the size of the guide corresponding to storing the guide with the ramp or the transverse member 106, or both, in the container 702.

The longitudinal members 222-230 may be fixedly or removably coupled to the transverse member 106. The arcuate members 233-235 may be fixedly or removably coupled to the longitudinal members 222-230. Removably coupling one or more of the longitudinal members 222-230, one or more of the arcuate members 233-235, or any combination thereof, facilitates storage of the guide 108 in a partially or entirely disassembled state within the container 702.

One or more containers holding the ramp 104, the transverse member 106, and the guide 108 may be transported to a given tending vessel. Assembly of the structure 100 may proceed in any order. The following order is for exemplary and non-limiting purposes.

The ramp 104 is removed from the container 702 and is inflated. The transverse member 106 is removed from the container 702 and can couple to the first coupling 231 and the second coupling 232. The guide 108 may be removed and if not an integral component of the transverse member 106, may be assembled to the transverse member.

The ramp 104 may be coupled at the first end 112 to the tending vessel 200 using lines via the first boss 110 and the second boss 114. The ramp 104 can couple at midpoints of the ramp to the tending vessel 200 by using lines via the first intermediate boss 116 and the second intermediate boss 118.

The second end 120 with the transverse member 106 and guide 108 coupled thereto, may be lowered to the water. The ramp 104 may thereby extend from the deck (or adjacent to the deck) to the water and the guide 108 may float (or not float depending on buoyancy) in the water. A line from the winch 246 can pass over the ramp 104 such that an end of the line trails the guide 108 in the water.

In a first example, the vehicle 500 may be moved from a deck of the tending vessel 200 to the water either by sliding the vehicle down the ramp or by lowering the vehicle using a crane or davit. The vehicle 500 may be held near the second end 120 of the ramp 104, above and within an imaginary zone bounded on at least two sides by a vertical projection of the outermost edges of the guide 108. Personnel, supplies, or other objects can be moved from the deck at the first end 112 toward the second end 120. Personnel, supplies, or other objects may be embarked onto the vehicle 500.

The vehicle 500 may approach the guide 108 from another ship, a submarine, or from the shore. The approaching vehicle is guided toward a center of the second end 120 of the ramp 104 by the shape of the guide 108. The vehicle 500 can be pulled within and secured with the edges of the guide 108 toward the second end 120 of the ramp 104 with a line or by the power of the vehicle.

In another example, the kit 700 includes the ramp 104 having the first end 112 and the second end 120. The kit 700 includes the transverse member 106 that can be coupled between a left (or first side) and a right side (or second side) of the ramp 104 at the second end 120. The kit 700 may still further include a plurality of longitudinal members 222-230 configured to extend from the transverse member 106 between the left side and the right side of the ramp 104 and a plurality of arcuate members 233-235 with each arcuate member configured to be coupled to each of the longitudinal members 222-230. The kit 700 may be packaged in the container 702, which may be configured to store at least the ramp 104, the transverse member 106, the optional transverse member 107, the longitudinal members 222-230 and the arcuate members 233-235.

In one example of the kit 700, the ramp 104 is foldable within the container 702. The longitudinal members 222-230 and the arcuate members 233-235 can be configured as a guide structure 108 and utilized to guide a vehicle away or toward the second end 120 of the ramp 104. The guide 108 may be assembled from individual ones of the longitudinal members 222-230 and the arcuate members 233-235.

The ramp 104 of the kit 700 may be inflatable using a gas which may be included with the kit (or which may be generated from a device and reactants included with the kit). The kit 700 may include at least one optional gas storage cylinder 704 containing the gas in a volume sufficient to inflate the ramp 104 to a predetermined pressure.

The kit 700 may include at least one chemical gas generator device with reactants 706. Combining the reactants 706 in the generator device generates gas in a volume sufficient to inflate the ramp 104 to a predetermined pressure.

The ramp 104, transverse member 106, and guide 108 can be scalable. Scalability allows the use of the structure for different types of vehicles that may require launching and recovery from different types of surface vessels.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A structure configured to launch and recover a vehicle, said structure comprising:

a ramp having a first end and a second end distal from said first end with said ramp having a first side and a second side between said first end and said second end;

a transverse member coupled between said first side and said second side of said ramp at said second end of said ramp;

a plurality of spaced apart longitudinal members extending from said transverse member between said first side and said second side of said ramp outward from said ramp; and a plurality of spaced apart arcuate members, each said arcuate member coupled traverse to each of said plurality of spaced apart longitudinal members;

wherein said plurality of spaced apart longitudinal members and said plurality of spaced apart arcuate members form a guide structure configured to guide the vehicle in regard to said second end of said ramp.

2. The structure of claim 1, further comprising:

a first boss at said first side of said ramp and at said first end of said ramp;

a second boss at said second side of said ramp and at said first end of said ramp;

a first coupling at said first side of the ramp at said second end of said ramp; and second end of said ramp;

wherein said first boss and said second boss are configured to couple said ramp to a tending vessel and said first coupling and said second coupling are configured to receive opposite ends of said transverse member.

3. The structure in accordance with claim 2, wherein said ramp comprises:

a first chamber along said first side of said ramp;

a second chamber along said second side of said ramp; and a floor chamber between and coupled to said first chamber and said second chamber.

4. The structure in accordance with claim 3, wherein said first chamber and said second chamber are integral as one chamber.

5. The structure of claim 3, wherein said first chamber and said second chamber are separate airtight chambers.

6. The structure of claim 5, wherein said first chamber and said second chamber are each divided into a plurality of sub-chambers.

7. The structure of claim 6, wherein each of said plurality of sub-chambers is filled with a gas.

8. The structure of claim 7, wherein the gas is generated by a chemical reaction.

9. The structure of claim 5, wherein said floor chamber is comprised of a plurality of contiguous floor chambers.

10. The structure of claim 9, wherein said plurality of contiguous floor chambers are inflated in groups and each of said groups is airtight.

11. A kit, comprising:

a ramp having a first end and a second end distal from said first end with said ramp having a first side and a second side between said first end and said second end;

a transverse member configured to be coupled between said first side and said second side of said ramp at said second end;

a plurality of longitudinal members configured to extend from said transverse member between said first side and said second side of said ramp;

a plurality of arcuate members, each arcuate member configured to be coupled to each of said plurality of longitudinal members;

wherein said longitudinal members and said arcuate members are configurable to form a guide structure to guide a vehicle at said second end of said ramp; and at least one container configured to store said ramp and at least one transverse member, said longitudinal members and said arcuate members, wherein said ramp is foldable within said container.

12. The kit of claim 11, wherein said guide structure is assembled from individual ones of said longitudinal members and said arcuate members stored within said container.

13. The kit of claim 12, wherein said the ramp is inflatable by gas.

14. The kit of claim 13, said kit further comprising at least one gas storage cylinder containing the gas in a volume sufficient to inflate said ramp to a predetermined pressure.

15. The kit in accordance with claim 13, said kit further comprising at least one chemical gas generator device containing reactants capable of generating gas in a volume sufficient to inflate said ramp to a predetermined pressure.

16. The kit in accordance with claim 13, said kit further comprising at least one gas generator device capable of generating compressed air in a volume sufficient to inflate said ramp to a predetermined pressure.

* * * * *